US008342860B1

(12) United States Patent
Steinbrecher

(10) Patent No.: US 8,342,860 B1
(45) Date of Patent: Jan. 1, 2013

(54) INTERFACE BOARD CONNECTOR

(75) Inventor: Donald H. Steinbrecher, Brookline, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/236,871

(22) Filed: Sep. 20, 2011

(51) Int. Cl.
*H01R 12/00* (2006.01)

(52) U.S. Cl. ..... 439/74

(58) Field of Classification Search ..... 439/74, 439/66, 63

See application file for complete search history.

(56) References Cited

U.S. PATENT DOCUMENTS 5,147,221 A * 9/1992 Cull et al. ..... 439/585
5,154,628 A * 10/1992 Skegin ..... 439/336
5,681,186 A * 10/1997 Wright ..... 439/675
6,488,512 B2 * 12/2002 Gonzales ..... 439/63
7,008,235 B2 * 3/2006 Watanabe ..... 439/63
7,108,514 B2 * 9/2006 Chen et al. ..... 439/63
7,766,662 B2 * 8/2010 Akama et al. ..... 439/63
2001/0051448 A1 * 12/2001 Gonzales ..... 439/63
2003/0190824 A1 * 10/2003 Ko ..... 439/63
2004/0102061 A1 * 5/2004 Watanabe ..... 439/63

* cited by examiner

*Primary Examiner* — Ross Gushi

(74) *Attorney, Agent, or Firm* — James M. Kasischke; Michael P. Stanley; Jean-Paul A. Nasser

(57) ABSTRACT

An interface board connector includes a plurality of individual conductive partition element seats. Each partition element seat includes four spring fingers that extend into apertures in a dielectric base plate of the interface assembly. Two adjacent spring fingers form a tweezers-like connector in one of the apertures that couples to a trace on a balun board contact post to form an impedance-matched extension of the balanced transmission line that is an integral part of the adjacent partition element seats. Each spring finger includes three distinct sections. A ramp section allows the balun board, when inserted, to push apart the two spring fingers and slide into place. The contact sections of two adjacent spring fingers form the electrical junction between the balanced transmission line traces on the balun board contact post and the section of balanced transmission line formed by the parallel spring sections of the two adjacent spring fingers.

20 Claims, 5 Drawing Sheets

INTERFACE BOARD CONNECTOR

STATEMENT OF GOVERNMENT INTEREST

The invention described herein may be manufactured and used by or for the Government of the United States of America for governmental purposes without the payment of any royalty thereon or therefore.

CROSS REFERENCE TO RELATED APPLICATION

Not applicable.

BACKGROUND OF THE INVENTION (1) Field of the Invention

The invention relates to connectors and is directed more particularly to removable balanced transmission line connectors.

(2) Description of the Prior Art

In telecommunications and professional audio, a balanced line format is used for good rejection of external noise. A balanced line or balanced signal pair refers to a transmission line consisting of two conductors of the same type, each of which have equal impedances along their lengths and equal impedances to ground and to other circuits. Circuits driving balanced lines must themselves be balanced to maintain the benefits of balance. This may be achieved by transformer coupling using a balun transformer.

For reliability, electrical connections between circuit boards or between circuit board components are generally soldered. Typically, a printed circuit board is mechanically supported by a dielectric base plate. The printed circuit board metallization provides electrical seats for the circuit elements.

The circuit board metallization is designed to enable an electrical connection to the metal traces that form a balanced transmission line on each balun board tongue, or contact post. The electrical connection is made by soldering the metal traces on the balun board contact post to the partition element electrical seats on the printed circuit board.

This method is satisfactory when the likelihood of a failure of one component or board is extremely small. In complex systems, wherein a large number of boards are interconnected, a failure of one of the boards will likely require nearly complete disassembly of the system in order to replace the failed board.

As an example, a variety of active circuits can be incorporated into individual balun boards that provide the electrical interface between partition elements and system electronics. Some balun boards can incorporate power amplifiers that will enable transmitters. Other boards can incorporate low noise receivers that will enable high dynamic range signals acquisition systems. Boards incorporating other active circuits can enable radio frequency generators and sensors for a variety of specialized applications.

The large numbers of active circuits can open the possibility to occasional component failure. When a failure does occur, it will particularly advantageous to be able to exchange one or more failed boards without disassembling the entire interface assembly. Additionally, the ability to exchange various components can provide greater design flexibility.

There is a need for a connector that allows for independent removal and replacement of each such interface board without disassembly of the entire interface. Further, the connector needs to provide a mechanically rigid connection and an electrically sound interface coupling.

SUMMARY OF THE INVENTION

The object of the present invention is, therefore, to provide a removable interface board connector. Further objects are to provide a mechanically rigid, electrically sound connector and a method for designing the connector.

With the above and other objects in view, an interface board connector includes a plurality of individual conductive partition element seats. Each partition element seat includes four spring fingers that extend into apertures in a dielectric base plate of the interface assembly. Two adjacent spring fingers form a tweezers-like connector in one of the apertures that couples to traces on a balun board contact post to form an impedance-matched extension of the balun balanced transmission line that is an integral part of the adjacent partition element seats.

Each spring finger includes three distinct sections. A ramp section allows the balun board, when inserted, to push apart the two spring fingers and slide into place. The contact sections of two adjacent spring fingers form the electrical junction between the balanced transmission line traces on the balun board contact post and the section of balanced transmission line formed by the parallel spring sections of the two adjacent spring fingers.

In one embodiment, an interface connector includes an interface element mounting plate and a plurality of spring sections, spaced apart at the periphery of the plate. The spring sections extend at an angle, t, generally orthogonal from the plate, wherein tan t≈t. The interface also includes a corresponding plurality of contact sections. Each contact section extends from one of the spring sections distal from the plate, with the contact section maintaining the angle, t. The contact sections have a stiffness greater than ten times the stiffness of the spring sections.

The interface can further include a dielectric support to which the plate is attached. The spring sections and contact sections extend through apertures in the dielectric support. The interface can include a plurality of the connectors attached to the support, wherein distal ends of the contact sections of one connector are in contact with distal ends of the contact sections of adjacent connectors.

Each spring finger can include a ramp section that extends from the contact section distant from the plate. The thickness of the ramp section can decrease linearly to a point distant from the contact section. Further, the width of the spring sections provides a 50-Ohm characteristic impedance.

In one embodiment, a method for designing an interface connector includes defining a set of variables based upon a known interface architecture. The set of variables can include a modulus of elasticity, E, an initial deflection, b, of the spring finger of the connector, a length, S, of the spring section of the spring finger, a width, u, of said spring section and a width, m, of said contact section. A value greater than 10 is selected for the ratio of the contact section stiffness to the spring section stiffness.

The method also includes setting either the spring section thickness or the contact pressure exerted by the contact section. When the spring section thickness is set, the value is used to obtain the contact pressure. If the obtained contact pressure is outside the range of about 6,000 Pascals to about 1 gigaPascal, the spring section thickness is varied until the obtained contact pressure is within this range. When the contact pressure is set, the value is used to obtain the spring section thickness. If the obtained spring section thickness is less than about 0.010 inch, the contact pressure is varied until the obtained spring section thickness is greater than about 0.010 inch.

Based on the finalized spring section thickness, a deflection angle and a spring finger offset are determined. Additionally, the thickness of the contact section is determined.

The method can further include choosing an incline angle for a ramp section of the spring finger and determining a length of the ramp section based on the incline angle and the contact section thickness. An engagement force between the spring finger and a contact post can be determined based in part on the incline angle. The incline angle can further be used to calculate the length of the transition between the spring section thickness and the contact section thickness.

The above and other features of the invention, including various novel details of construction and combinations of parts, will now be more particularly described with reference to the accompanying drawings and pointed out in the claims.

It will be understood that the particular assembly embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the several views of the drawings and wherein.

DETAILED DESCRIPTION OF THE INVENTION

Figure 1:
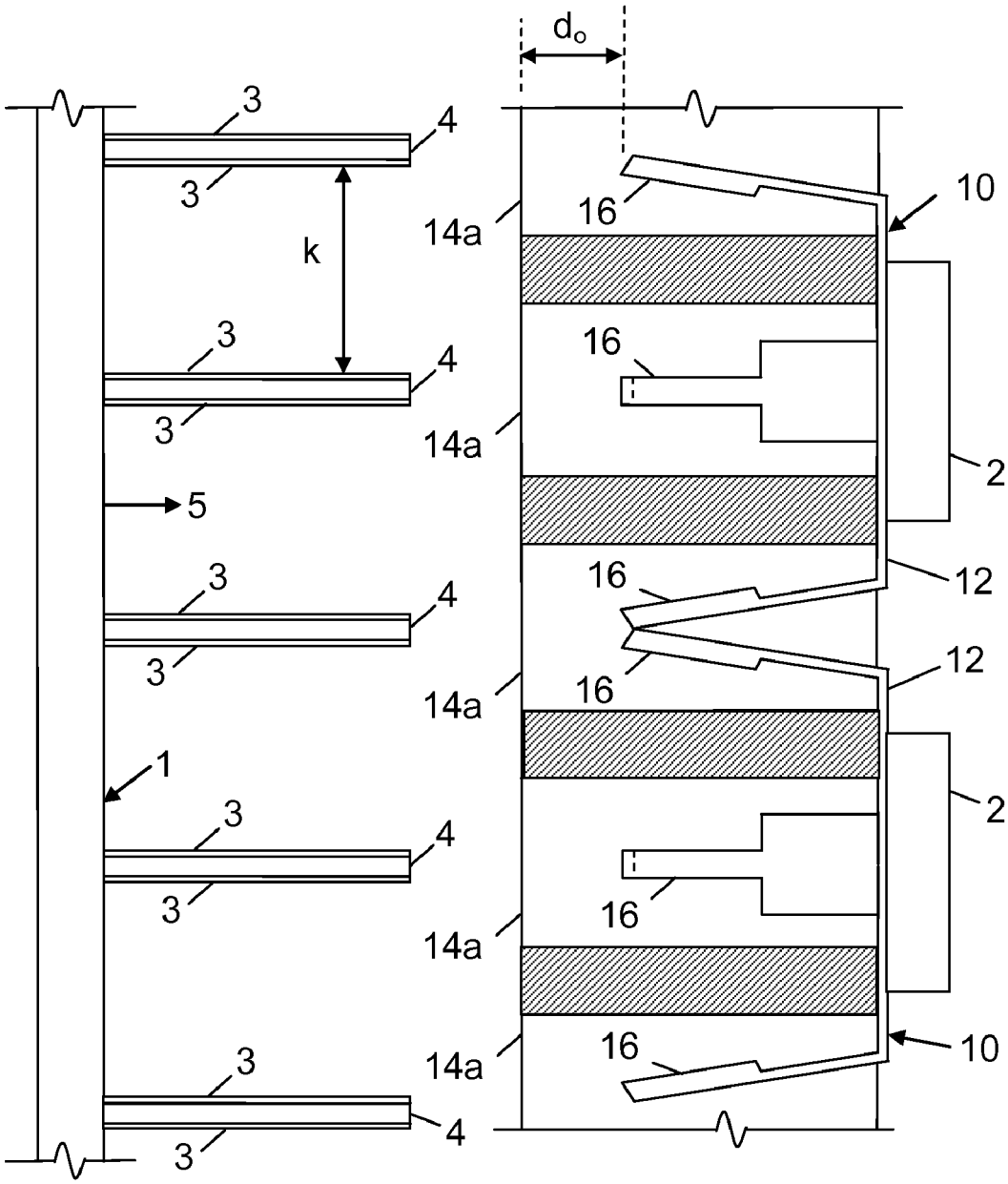
FIG. 1 shows a partial side view of a plurality of interface board connectors.

Referring to FIG. 1, there is shown an exploded, partial side view of a generalized embodiment of a plurality of interface board connectors 10. Connectors 10 enable an electrical connection between prior art balun board 1 and partition elements 2. As is known to those of skill in the art, metal traces 3 on tongues, or contact posts 4 of balun board 1 form a balanced transmission line on balun board 1.

Element seat plates 12 of connectors 10 are supported by dielectric 14 and prior art partition elements 2 are electrically connected to plates 12. Spring fingers 16 of connectors 10 extend generally orthogonally from plates 12 through apertures 14*a* formed in dielectric 14. For clarity and ease of visualization, solid portions of dielectric 14 are cross-hatched.

When balun board 1 is positioned adjacent to dielectric 14 (by movement in the direction of arrow 5 of FIG. 1), contact posts 4 are inserted into corresponding apertures 14*a*. Spring fingers 16 contact metal traces 3 to form the electrical connection between balun board 1 and partition elements 2.

Figure 2:
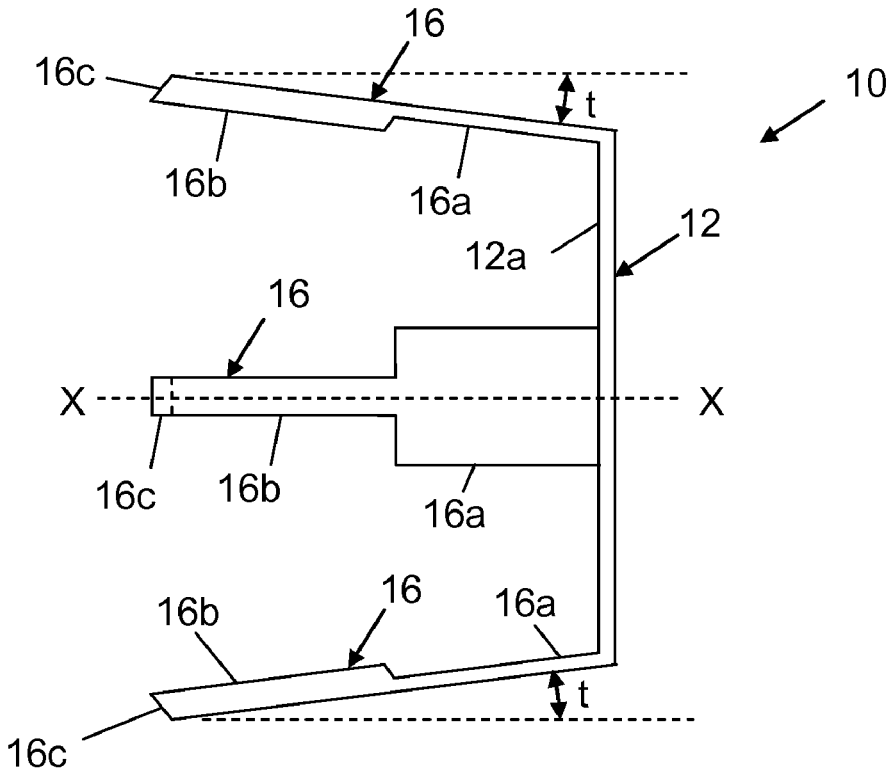
FIG. 2 shows shown a detailed side view of an interface board connector.

Referring now to FIG. 2, there is shown a detailed side view of connector 10, corresponding to the orientation of FIG. 1. The number of spring fingers 16 and their spacing will depend on the architecture of the interface board. For illustration, but not limitation, connector 10 of FIG. 2 includes four spring fingers 16, spaced 90° apart about central axis X-X of connector 10, one of which is hidden in FIG. 2.

Each spring finger 16 extends away from element surface 12*a* of plate 12 and away from axis X-X at an angle, t, wherein the known small angle approximation tan t≈t is valid. Each spring finger 16 is formed of spring section 16*a*, contact section 16*b* and ramp section 16*c*. Spring section 16*a* is proximal to and is attached to plate 12. Ramp section 16*c* is distal from plate 12, with contact section 16*b* between spring section 16*a* and ramp section 16*c*.

Spring section 16*a* is fabricated to have a much smaller moment of inertia than contact section 16*b*, such that bending deflections of spring finger 16 in a direction towards axis X-X are generally confined to spring section 16*a*. Ramp section 16*c* tapers from contact section 16*b* inward towards axis X-X.

Figure 3:
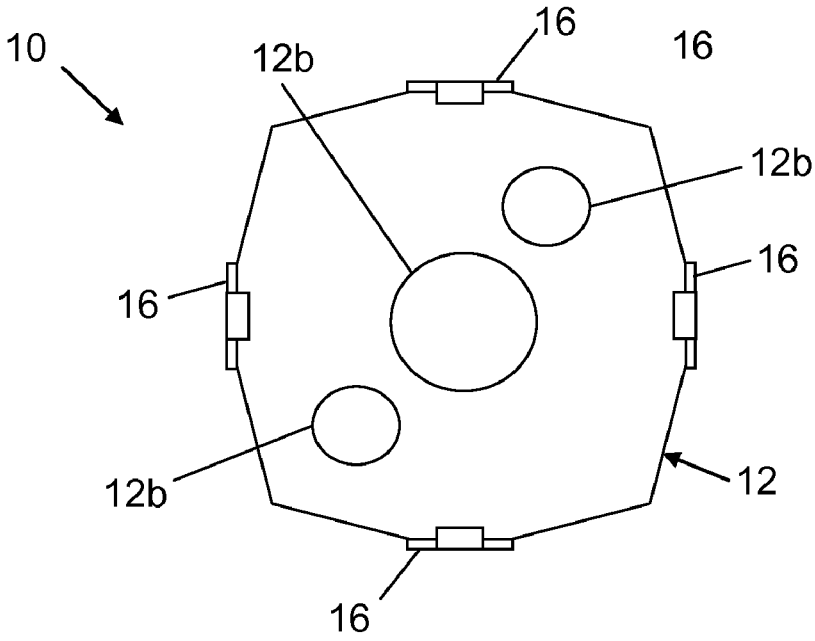
FIG. 3 shows a detailed plan view of a connector.

Referring now to FIG. 3, there is shown a detailed plan view of connector 10, taken from the perspective of balun board 1 of FIG. 1. As noted previously with respect to FIG. 2, the configuration of plate 12 depends on the architecture of the interface board. For illustrative purposes and for conformance with FIG. 2, but not for limitation, plate 12 is shown having a generally octagonal shape, with spring fingers 16 at alternate apexes. In addition, plate 12 can include openings 12*b* for alignment pins and mounting bolts, as is known in the art.

Figure 4:
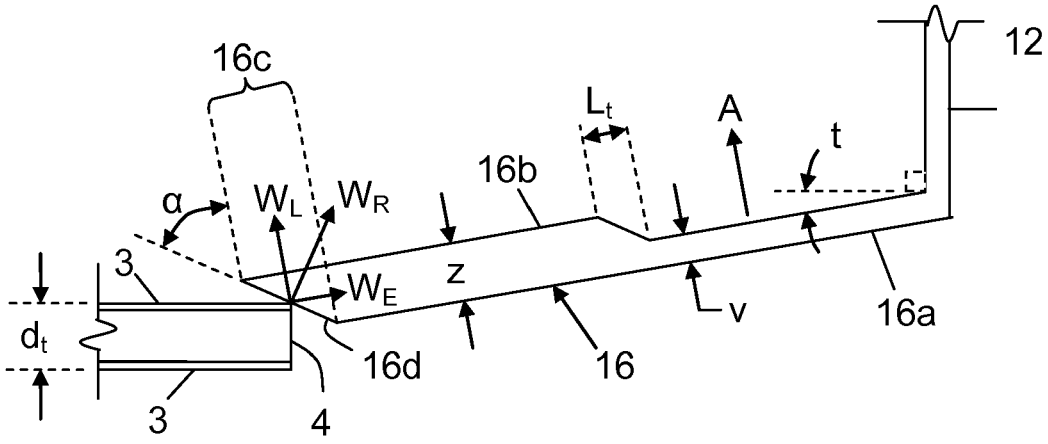
FIG. 4 shows a partial side view of a contact post engaging a connector.

Referring now also to FIG. 4, there is shown a partial side view of contact post 4 engaging spring finger 16. As contact post 4 contacts face 16*d* of ramp section 16*c* and is moved further towards plate 12, force $W_R$ is exerted normal to face 16*d* and spring section 16*a* begins to deflect towards axis X-X (as shown by arrow A).

Due to its larger moment of inertia, essentially no deflection occurs in contact section 16*b*. Accordingly, when contact post 4 is moved fully towards plate 12, spring section 16*a* deflects through angle t (shown in FIG. 2) such that contact section 16*b* is in full contact with metal traces 3 on contact post 4.

Figure 5:
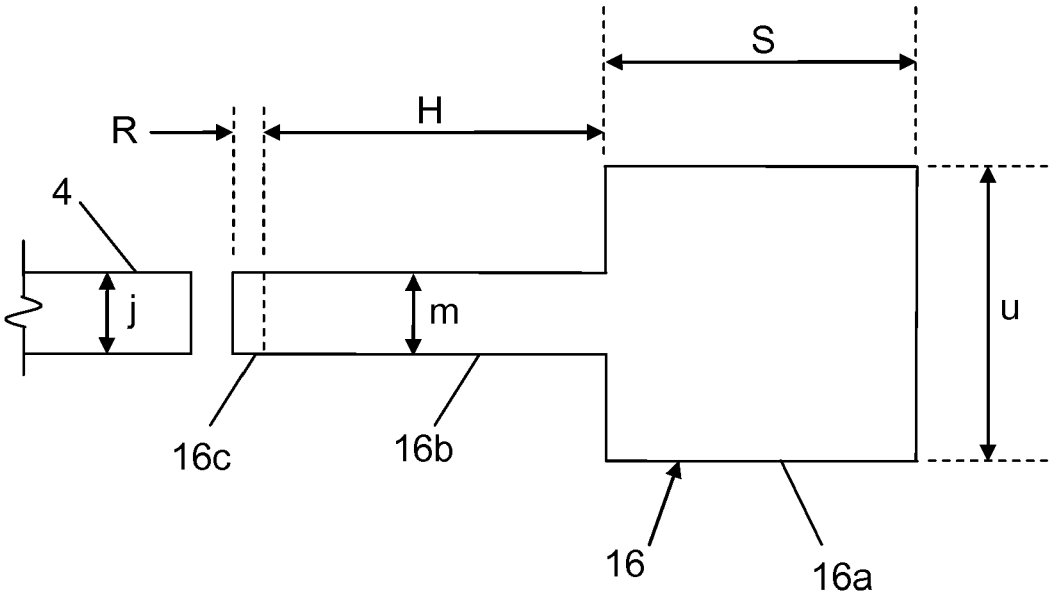
FIG. 5 shows a partial plan view of a connector corresponding to the side view of FIG. 4.

Referring also to FIG. 5, there is shown a partial plan view of spring finger 16, corresponding to the side view of FIG. 4, with contact post 4 being shown removed from spring finger 16. As shown in FIG. 5, the lengths of spring section 16*a*, contact section 16*b* and ramp section 16*c* are designated as S, H and R, respectively. The widths of spring section 16*a* and contact section 16*b* are designated as u and m, respectively. Referring back to FIG. 4, the thicknesses of spring section 16*a* and contact section 16*b* are designated as v and z, respectively.

Figure 6:
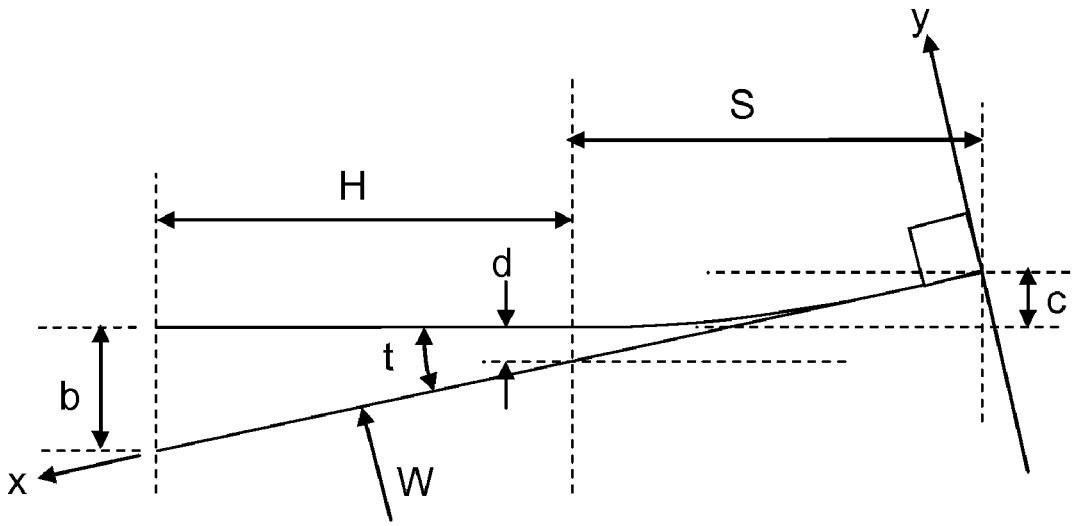
FIG. 6 shows a schematic representation of the geometry of a spring finger portion of a connector.

Referring now to FIG. 6, there is shown a schematic representation of the geometry of a spring finger. In FIG. 6, the x and y coordinate axes are aligned with the initial un-deformed position of the spring finger in order to permit the application of standard beam deflection theory to the problem. As noted with respect to FIG. 2, slight variations in the vertical dimensions caused the initial deflection angle can be ignored since tan t≈t.

When a force W is applied, as would be the case when contact post 4 advances past ramp section 12*c* in FIG. 4, the spring section (denoted by length S in FIG. 6) of the spring finger deflects until the contact section (denoted by length H in FIG. 6) becomes horizontal. To ensure that almost all bending occurs in the spring section and the contact section remains relatively unbent, the moment of inertia of the contact section can be set significantly larger than the moment of inertia of the spring section.

As is known to those of skill in the art, the beam deflection equation is:

$$y = \frac{W}{6EI}(3x^2(x_W) - x^3), \quad \text{where} \tag{1}$$

y is the ordinate, x is the abscissa,

W is the force applied at $x=x_w$,

E is the material modulus of elasticity, and

I is the moment of inertia of the beam, or spring finger.

For ease of calculation and derivation, the length of the contact section, H, is set equal to the length of the spring section, S. Further, since we have taken the contact section to be horizontal, it would be in full contact with a contact post. Accordingly, W can be considered to act in the middle of the contact section, as shown in FIG. 6.

It follows that $x_w=(3S/2)$. Then, the deflection at the junction between the contact section and the spring section, where x=S, is:

$$y(x = S) = \frac{7W}{12EI}S^3 \tag{2}$$

Also, the derivative of y with respect to x, evaluated at x=S is:

$$\frac{dy}{dx}(x = S) = y'(x = S) = \frac{W}{EI}S^2 \tag{3}$$

For uniform contact pressure over the contact region, the slope of the spring finger at x=S should be equal to the angle t, as defined in FIGS. 2 and 6. Thus, two conditions need to be met simultaneously at x=S. First, when the balun board is fully inserted, y=d, where d is the initial value of y at x=S, as shown in FIG. 6. Second and simultaneously, the derivative of y with respect to x is equal to t, or y'=t.

The first and second conditions lead to the respective equations:

$$\frac{7W}{12EI}S^3 = d = \frac{(b-c)}{2} \quad \text{and, knowing that } \tan t \approx t, \tag{4}$$

$$\frac{W}{EI}S^2 = t = \frac{(c+b)}{2S}, \quad \text{where} \tag{5}$$

b is the initial deflection or value of y at x=2S; and c is the initial value of y at x=0.

Solving equations 4 and 5 simultaneously, a relationship between b and c is found that, when met, leads to simultaneously satisfying the aforementioned first and second conditions:

$$c = \frac{5}{19}b. \tag{6}$$

A number of the variables required for the design of a spring finger can be determined by the basic architecture of the interface board. For example, the initial deflection, b, is taken as half of the depth, $d_t$, of contact post 4 that mates with spring finger 16 (FIG. 4). In this manner, contact between adjacent spring fingers 16 is maintained prior to contact post 4 being inserted, as shown in FIG. 1. Also, the width, m, of contact section 16*b* will match the width, j, of contact post 4 (FIG. 4).

Further, it is desirable that the full length of a contact section lie adjacent the contact post. Accordingly, the length of the contact section, H, plus the length of the ramp section, R, is set less than or equal to the length, k, of contact post 4 less the dielectric coverage, $d_o$ (FIG. 1), or $(H+R)<(k-d_o)$. Since the length of the contact section, H, was set equal to that of the spring section, this requirement also determines the length of the spring section, S.

The length of the ramp section, R, will depend on the thickness of the contact section, z, and a reasonable value for incline angle, α (FIG. 4), such that tan(α)=R/z. Similarly, the incline angle, α, can be used for the transition between the spring section and the contact section, such that the transition length, $L_t$ (FIG. 4), also depends on α, i.e., $L_t=(z-v)\tan(\alpha)$.

The modulus of elasticity, E, depends on the materials used. Further, the width, u, of the spring section can be determined by the electrical requirement for 50-Ohm characteristic impedance, as is known to those of skill in the art.

The force, W, can be related to the moment of inertia of the spring section, which leads to a determination of the spring-section thickness. Combining equations 4 and 6 results in the relation:

$$W = \frac{12bE}{19S^3}I. \tag{7}$$

Using the dimensions designated in FIGS. 4 and 5, the moment of inertia of spring section 16*a* is:

$$I = \frac{uv^3}{12}. \tag{8}$$

Accordingly, the force, W, is proportional to the cube of the spring section thickness, v. If a reasonable force, W, can be determined, the thickness, v, can be obtained from equations 7 and 8.

As is known, gold plating is used for most contact surfaces. Gold to gold contact resistance flattens above a pressure of 6,000 Pascals; and the onset of gold deformation is about 1 giga-Pascal. Thus, a reasonable contact force value lies between these two values.

Since small variations in the spring thickness will result in large variations in the force applied to the contact area, control of the spring thickness during fabrication is critical. As is known, thicknesses less than about 0.010 inch can be difficult to replicate with satisfactory consistency.

Accordingly, a spring thickness of 0.010 inch can be chosen as a minimum value, with the constraint that the resulting contact pressure, i.e., W/mS, be greater than 6,000 Pascal, but less than 1 giga-Pascal. Conversely, a reasonable contact pressure can be chosen with the constraint that the resulting spring thickness is greater than 0.010 inch.

Figure 7:
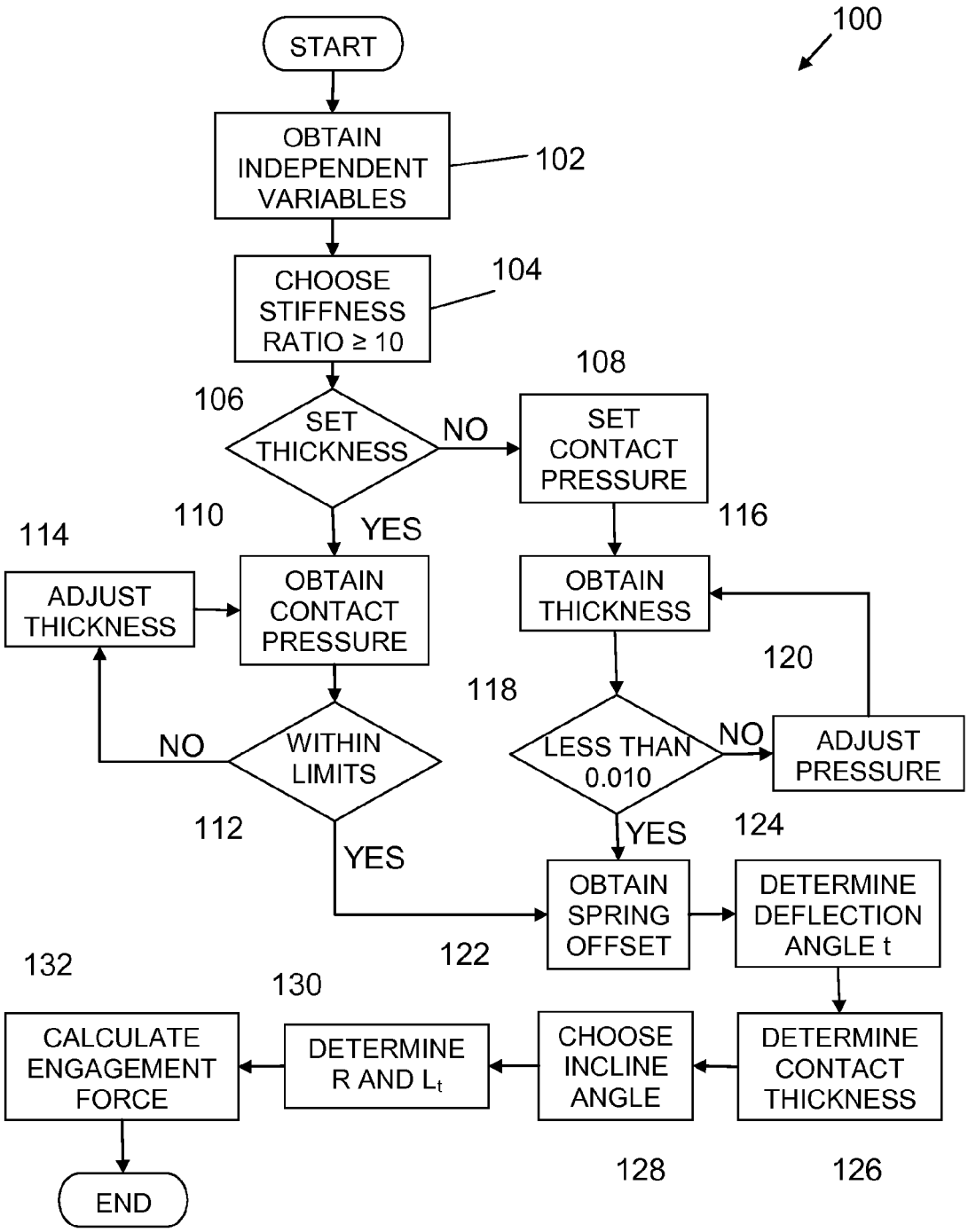
FIG. 7 is a block diagram of method for the design of a spring finger.

Referring now to FIG. 7, there is shown a block diagram of method 100 for the design of a spring finger. At block 102 the independent variables are obtained based on the materials used and the architecture of the interface, as described hereinbefore. These include:

E, the modulus of elasticity, b, the initial deflection,

S, the length of the spring section

H, the length of the contact section (set equal to S), u, the width of the spring section, and m, the width of the contact section.

At block 104, the ratio between the moments of inertia of the contact section and the spring section is chosen such that bending is generally confined to the spring section. A ratio of 10 or greater has been found to be adequate, i.e., $$\frac{mz^3}{12} \geq 10\frac{uv^3}{12}, \text{ or } mz^3 \geq 10uv^3. \quad (9)$$

As noted previously, either the spring thickness, v, or the contact pressure, W/mS, can be set, as shown at blocks 106 and 108. If the spring thickness is set, the contact pressure is determined from equations 7 and 8 at block 110. If the resulting contact pressure is not within acceptable limits, i.e., the contact pressure is less than 6,000 Pascal or greater than 1 giga-Pascal, as determined at block 112, the spring thickness is adjusted at block 114 and method 100 returns to block 110 to determine the new contact pressure.

If the contact pressure is set, the spring thickness is determined from equations 7 and 8 at block 116. If the spring thickness is less than 0.010, as determined at block 118, the contact pressure is adjusted at block 120 and method 100 returns to block 116 to determine the new spring thickness. As can be seen from equation 7, an increase or decrease of the spring thickness results in a commensurate increase or decrease of the contact pressure, and vice versa.

Once the spring thickness is finalized, either from block 112 or from block 118, the remaining spring design parameters can be obtained. The spring offset, c, is obtained at block 122 from equation 6 and the deflection angle, t, is determined at block 124 from equation 5. At block 126, the contact thickness, z, is determined from equation 9.

At block 128, the incline angle can be chosen, such that the ramp length, R, and the transition length, $L_t$, are determined at block 130 from the previously described relations: $\tan(\alpha)=R/z$ and $L_t=(z-v)\tan(\alpha)$. The incline angle can also be used to obtain the engagement force component, of normal force $W_R$, as shown in FIG. 4. The engagement force, $W_E$, is that force necessary to push the contact post into contact with a spring finger based on the relation:

$$\tan(\alpha)=W_L/W_E, \text{ where} \quad (10)$$

$W_L$ (FIG. 4) is the lifting force component of Force $W_L$ is calculated from equation 1 with y=d and $x_w$=2S. Thus, to insert the contact post between two adjacent spring fingers requires a force of $2W_E$. Accordingly, block 132 calculates the engagement force based on equations 1 and 10.

What has thus been described is a design for an interface board connector 10 and a design method 100 that provide for independent removal and replacement of each such interface board without disassembly of the entire interface. If partition element 2 on connector 10 fails, or a new interface design requires changing partition element 2, connector 10 is simply removed from the interface and a new connector with the new partition element is attached. Using connector 10, there are no soldered connections that require removal.

The design method 100 of connector 10 provides a mechanically rigid connection and an electrically sound interface coupling. The design method ensures full contact of contact section 16*b* along contact post 4, with sufficient force, W, to provide a sound connection.

It will be understood that many additional changes in the details, materials, and arrangement of parts, which have been herein described and illustrated in order to explain the nature of the invention, may be made by those skilled in the art within the principles and scope of the invention as expressed in the appended claims.

What is claimed is:

1. An interface connector, comprising:

an interface element mounting plate;

a plurality of spring sections, spaced apart at a periphery of said plate, said spring sections extending at an angle, t, generally orthogonal from said plate, wherein tan t≈t; and a corresponding plurality of contact sections, each contact section extending from one of said spring sections distal from said plate and maintaining said angle t, said contact sections having a stiffness greater than ten times a stiffness of said spring sections.

2. The interface of claim 1, further comprising a dielectric support, said plate being attached to said support, said spring sections and contact sections extending through apertures in said support.

3. The interface of claim 2, further comprising a plurality of said connectors attached to said support, wherein a first distal end of a first contact section of one connector is in contact with a second distal end of a second contact section of an adjacent connector.

4. The interface of claim 3, further comprising a corresponding plurality of ramp sections, each ramp section extending from one of said contact sections distal from said plate, a thickness of said ramp section decreasing linearly to a point distal from said contact section.

5. The interface of claim 4, wherein a width of said spring sections provides a 50-Ohm characteristic impedance.

6. The interface of claim 1, wherein a width of said spring sections provides a 50-Ohm characteristic impedance.

7. The interface of claim 6, further comprising a corresponding plurality of ramp sections, each ramp section extending from one of said contact sections distal from said plate, a thickness of said ramp section decreasing linearly to a point distal from said contact section.

8. The interface of claim 1, further comprising a corresponding plurality of ramp sections, each ramp section extending from one of said contact sections distal from said plate, a thickness of said ramp section decreasing linearly to a point distal from said contact section.

9. A method for designing an interface connector, comprising the steps of:

defining a set of variables based on a known interface architecture, said set comprising a modulus of elasticity, E, an initial deflection, b, of a spring finger of said connector, a length, S, of a spring section of said spring finger, a width, u, of said spring section and a width, m, of said contact section;

selecting a value for a ratio of a stiffness of said contact section to a stiffness of said spring section, wherein said value is greater than 10;

at least one of setting a thickness of said spring section and setting a value of a contact pressure exerted by said contact section;

finalizing said spring section thickness;

determining a deflection angle and an offset of said spring finger; and determining a thickness of said contact section.

10. The method of claim 9, further comprising:

choosing an incline angle for a ramp section of said spring finger; and determining a length of said ramp section based on said incline angle and said contact section thickness.

11. The method of claim 10, further comprising calculating an engagement force based in part on said incline angle.

12. The method of claim 11, further comprising determining a transition length between said spring section and said contact section based on said incline angle and a difference between said contact section thickness and said spring section thickness.

13. The method of claim 9, wherein finalizing said spring section thickness based on setting said spring section thickness comprises:

obtaining said contact pressure;

determining if said contact pressure is in a range between about 6,000 Pascals and one giga-Pascal; and iteratively adjusting said spring section thickness and obtaining said contact pressure until said contact pressure is within said range.

14. The method of claim 13, further comprising:

choosing an incline angle for a ramp section of said spring finger; and determining a length of said ramp section based on said incline angle and said contact section thickness.

15. The method of claim 14, further comprising calculating an engagement force based in part on said incline angle.

16. The method of claim 15, further comprising determining a transition length between said spring section and said contact section based on said incline angle and a difference between said contact section thickness and said spring section thickness.

17. The method of claim 9, wherein finalizing said spring section thickness based on setting said contact force comprises:

obtaining said spring section thickness;

determining if said spring section thickness is greater than about 0.010 inch; and iteratively adjusting said contact pressure and obtaining said spring section thickness until said spring section thickness is within said range.

18. The method of claim 17, further comprising:

choosing an incline angle for a ramp section of said spring finger; and determining a length of said ramp section based on said incline angle and said contact section thickness.

19. The method of claim 18, further comprising calculating an engagement force based in part on said incline angle.

20. The method of claim 19, further comprising determining a transition length between said spring section and said contact section based on said incline angle and a difference between said contact section thickness and said spring section thickness.

* * * * *